United States Patent [19]

Kuttruf

[11] Patent Number: 5,058,484

[45] Date of Patent: Oct. 22, 1991

[54] ELECTROHYDRAULIC CONTROL ARRANGEMENT FOR CONTROLLING A HYDRAULIC DRIVE

[75] Inventor: Werner Kuttruf, Scottweg, Fed. Rep. of Germany

[73] Assignee: BW Hydraulik GmbH, Wuppertal, Fed. Rep. of Germany

[21] Appl. No.: 458,781

[22] Filed: Dec. 29, 1989

[30] Foreign Application Priority Data

Jan. 14, 1989 [DE] Fed. Rep. of Germany ..... 3900949

[51] Int. Cl.[5] ..... F15B 11/08

[52] U.S. Cl. ..... 91/461; 91/464; 91/465; 137/636.1

[58] Field of Search ..... 91/461, 464, 465; 137/636.1; 251/129.03

[56] References Cited

U.S. PATENT DOCUMENTS

| | | | |
|---|---|---|---|
| 2,342,770 | 2/1944 | Temple | 137/636.1 |
| 4,286,432 | 9/1981 | Burrows et al. | 91/461 |
| 4,484,599 | 11/1984 | Hanover et al. | 137/636.1 |
| 4,508,443 | 4/1985 | Ogabaward | 137/636.1 |
| 4,523,513 | 6/1985 | Gudst et al. | 91/464 X |
| 4,616,674 | 10/1986 | Bardoll | 91/465 X |
| 4,754,693 | 7/1988 | Teltscher | 91/464 |

*Primary Examiner*—Edward K. Look
*Assistant Examiner*—Todd Mattingly
*Attorney, Agent, or Firm*—Robert W. Becker & Associates

[57] ABSTRACT

An electrohydraulic control arrangement for controlling a hydraulic cylinder having a double-acting working piston. At least one control valve having a control slide unit that is spring-loaded at one end and can be shifted by a servomotor against the spring force is provided. A valve housing having at least one section is provided with at least one control valve for alliance with each of the pressure chambers of the hydraulic cylinder, with the control slide units of the control valves being spaced from one another and being coaxially disposed in a mirror symmetrical manner relative to one another. A common control element of the servomotor is disposed between the inner ends of the control slide units for moving the same in the same direction. Each control slide unit has a pressure chamber containing an auxiliary piston, with at least one switching valve connecting these pressure chambers with pressure medium for moving the control slide units inot an inactive position that avoids the effect of the control element. This inactive position, or "not-stop-function", can be directly controlled from any switching position of the control slide units. In the inactive position, the servomotor can be moved into its neutral position and adjusted without thereby causing movements of the piston of the hydraulic cylinder.

1 Claim, 3 Drawing Sheets

ELECTROHYDRAULIC CONTROL ARRANGEMENT FOR CONTROLLING A HYDRAULIC DRIVE

BACKGROUND OF THE INVENTION

The present invention relates to an electrohydraulic control arrangement for controlling a hydraulic drive means, such as a hydraulic cylinder in which each of the opposed sides of a double-acting working piston delimits a pressure chamber, with the arrangement including at least one control valve that is provided with a control slide unit that is spring-loaded at one end and can be shifted out of a rest position against the spring force, and with the arrangement also including a servomotor for controlling the control slide unit.

To form electrohydraulic control arrangements, directly controlled regulating valves are generally utilized; these valves can also be designated as electrohydraulic continuous valves. Such a regulating valve contains, in the valve housing, a spring-loaded control slide unit on which are disposed all of the leading edges that are required. These leading edges must be functionally balanced at manufacture; they cannot be subsequently adjusted relative to one another, not even partially. Due to the influence of a return spring, the control slide unit is held in a mechanically limited end position that at the same time represents the so-called "not-stop-function". From this end position, the control slide unit can be moved by the force of a solenoid (control magnet) into the various valve positions in order to attain the respectively desired hydraulic symbol. The extent of the stroke movement of the control magnet (theoretical value) is determined by a distance-measuring system. With a suitable control, a control circuit can be provided with such an arrangement.

With one such directly controlled regulating valve, the neutral position cannot be detected directly; rather, this neutral position can be determined only indirectly via the performance of the receiving device that is to be controlled. This is extremely unsatisfactory since during adjustment or activation of the regulating valve this leads to undesired and uncontrolled movements of the consuming device that is connected thereto.

A further drawback is that the so-called "not-stop-function" (regulating valve inactive) cannot be controlled separately; rather, this function is possible only by removal of the setting means. However, since the position of the control slide unit in the mechanical end position is not identical to the neutral position of the regulating valve (controlled condition), when the "not-stop-function" is established one or more symbol positions of the regulating valve are always passed over. This inherently leads to undesired and uncontrollable movements at the consuming device. Furthermore, impermissibly high delays occur at the consuming device upon disconnection from one of the possible regulating conditions having greater preset values; associated with these delays is a danger of damage in the hydraulic system. In order to counteract these negative effects, additional precautions have been adopted by installing a separate "not-stop-valve" in the pressure medium feed line and/or by installing safety pressure valves in the consuming device lines.

It an object of the present invention to obviate these drawbacks, and in particular to provide an electrohydraulic control arrangement with which the control valve can be activated independently of the respective presetting of the servomotor for controlling the control valve. In so doing, the setting of the control valve into the positions "active" or "inactive" should always have priority relative to the presetting value. In addition, the control arrangement should be such that upon reactivation of the arrangement, the presetting value can be adjusted independently of the position of the control valve, i.e. it should be possible to move the servomotor into the neutral position without any movements of the consuming device being connected therewith.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
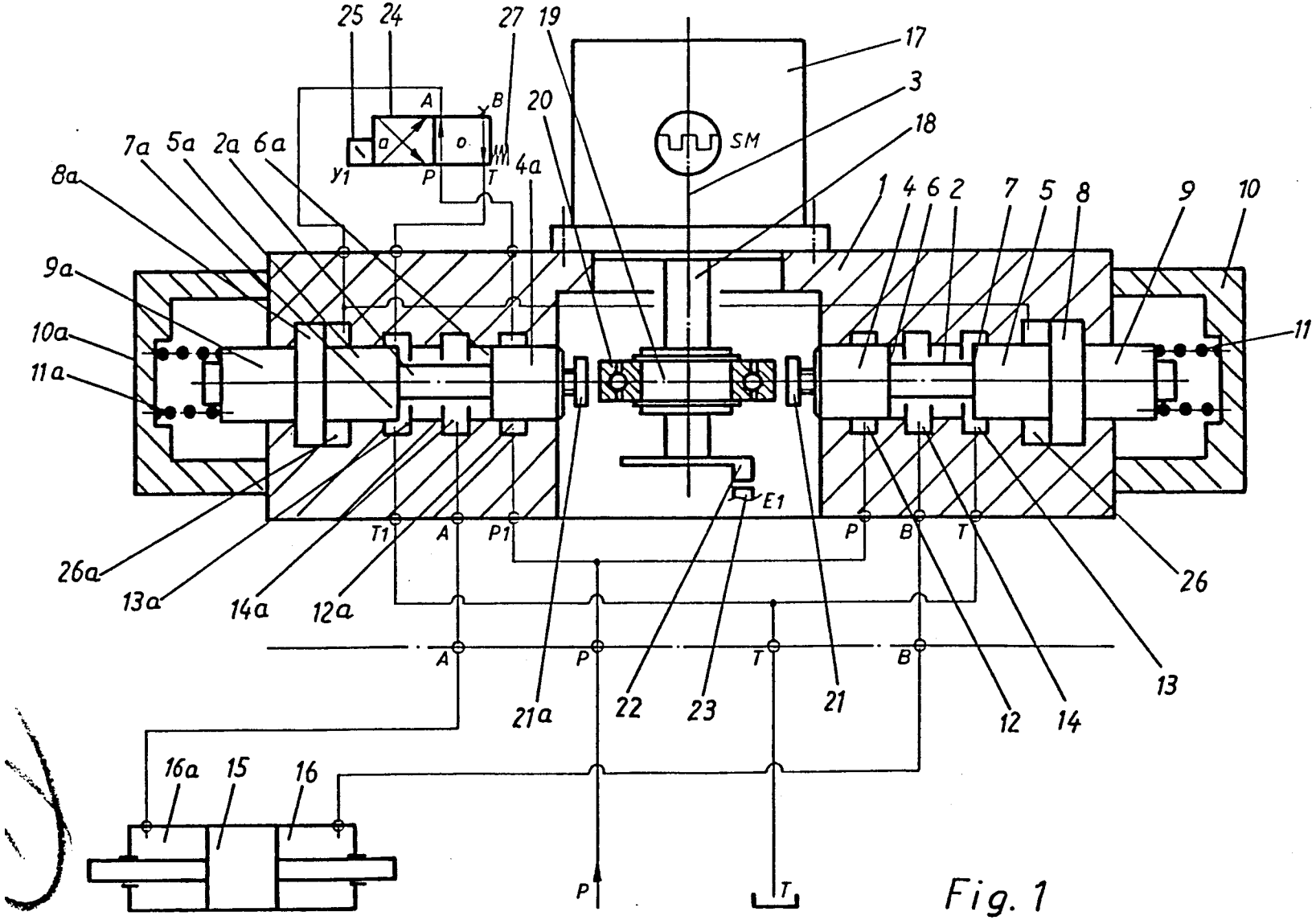
FIG. 1 is an axial cross-sectional view through one exemplary embodiment of the present invention of a double control valve for controlling a hydraulic cylinder that is acted upon from both sides.

The electrohydraulic control arrangement of the present invention is characterized primarily by: a valve housing having one or more sections provided with at least one control valve for alliance with each of the pressure chambers of the hydraulic cylinder, with the control slide units of the control valves being spaced from one another and being coaxially disposed in a mirror symmetrical manner relative to one another; a common control element connected to the servomotor and disposed between facing, non spring-loaded inner ends of the control slide units for moving the same in the same direction via mechanical pressure contact; for each control slide unit, a pressure chamber that contains an auxiliary piston; and at least one switching valve for connecting the pressure chambers of the control slide units with pressure medium for moving the control slide units in a direction counter to the spring force to thereby move the control slide unit into an inactive position that avoids the effect of the control element of the servomotor, whereby in the inactive position both of the pressure chambers of the hydraulic cylinder are connected to a first line that leads to a tank, while a second line coming from a supply of pressure medium, for example oil under pressure, is cut off by the control slide units.

Pursuant to a critical concept of the present invention, the main control valve, in a common valve housing, contains at least two control slide units that are disposed in a mirror symmetrical manner and can be moved in the same direction, with the control slide units having control pistons disposed thereon that each control one pressure chamber of the consuming device, i.e.

the hydraulic cylinder. In this connection, the presetting value is simultaneously transmitted to both control slide units via a common control element of the servomotor. For the "not-stop-function", each of the control slide units has an auxiliary piston in a respective pressure chamber. In this way, the "not-stop-function" can be achieved directly with the aid of a switching valve, and in particular independent of the respective regulating condition of the two control valves. In the position "not-stop-function", i.e. in the inactive position of the control valves, the neutral position of the control element of the servomotor can be adjusted without moving the consuming device, although the supply of oil under pressure is still available. Thus at the same time a two-channel control of the control valves results. A further advantage of the inventive structural splitting of the control valves, and of the simultaneously provided symmetrically oppositely disposed arrangement of the control slide units, is in the compensation of the hydraulic contact pressures.

Pursuant to one advantageous specific embodiment of the inventive electrohydraulic control arrangement, the control element of the servomotor is embodied as an eccentrically mounted lifting ring, the outer surface of which serves as a support surface for the inner end of the two control slide units.

In order to be able to adjust the control slide units axially relative to one another, it is expedient to dispose at their inner end axially adjustable components, such as a screw or a spindle. Each individual control valve is expediently embodied as a known 3/3-way slide valve.

The inactive position of the control slide units, i.e. the position "not-stop-function", can be mechanically fixed by providing for the auxiliary piston of the control slide unit a mechanical stop means, for example the end wall of the cylinder space.

To set the neutral position of the servomotor, it is expedient to connect to the rotatable lifting ring a trip or contact cam that in the neutral position can activate a zero or neutral-point switch.

Further specific features of the present invention will be described in detail subsequently.

DESCRIPTION OF PREFERRED EMBODIMENTS

Referring now to the drawings in detail, in the embodiment illustrated in FIG. 1, two identical control slide valve units 2, 2*a* are coaxially disposed in a housing 1. The control slide units 2, 2*a* are disposed in a mirror-inverted manner so as to be symmetrical relative to the central plane 3. Since the two control slide units 2, 2*a*, and hence also the control valves, have the same construction, only one of the control valves will be described in the following paragraphs. Since the same description applies to the second control valve, the same reference numerals, followed by an "a", will be used therefor.

The individual control valves are embodied in the manner of a conventional 3/3-way slide valve. The control slide unit 2, 2*a* contains two control pistons 4, 5, each of which has a leading edge 6, 7, and further contains an auxiliary piston 8. The control pistons 4 and 5 and the auxiliary piston 8 are interconnected and, together with a piston rod 9 that is disposed at one end and extends out of the valve housing 1, form the axially movable control slide valve unit 2. Disposed between the free end face of the piston rod 9 and an end cap 10 is a helical compression spring 11 that urges the control slide unit 2 out of the illustrated mechanical end position in the opposite direction.

In the range of the stroke movement of the control pistons 4, 5, respective circumferential annular grooves 12, 13 are contained in the guide bore of the valve housing 1. Connected to the annular groove 12 is the line p that comes from the non-illustrated source of pressure medium, while connected to the annular groove 13 is the line T that leads to the tank. Disposed between the two annular grooves 12, 13 is a central annular groove 14 to which is connected a line B that leads to the hydraulic cylinder 15, and in particular leads to the pressure chamber 16.

Flanged onto the side of the valve housing 1 is a reference motor 17, for example an electric stepping motor. The drive shaft 18 of the motor 17 is coupled with an eccentric ring 19 that carries a roller bearing for example a ball bearing having an outer ring 20. The outer ring 20 serves as a mechanical support for the spring-loaded control slide valve unit 2, 2*a*. In order to be able to adjust the axial length of the two control slide units 2, 2*a* independently of one another, disposed on the free end face of the control piston 4 is a component such as a screw or spindle, the axial length of which is adjustable. As long as the auxiliary piston 8, the significance of which will be described subsequently, is not acted upon, the component 21, under the effect of the force of the compression spring 11, is in pressure contact with the outer ring 20 of the eccentric ring 19.

The reference motor 17 can be moved into a neutral position. To set this neutral position, a trip or contact cam 22 is connected with the drive shaft 18 of the motor 17; when the neutral position is reached, the trip cam 22 activates a known neutral-point switch 23.

The eccentric ring 19 is disposed in such a way that in the aforementioned neutral position, the components 21 and 21*a* that rest against the outer ring 20 of the eccentric ring 19 are spaced the same radial distance from the axis of rotation of the shaft 18. As the motor 17 rotates, this radial spacing increases on one side and decreases to the same extent on the other side, and vice versa. In this way, by rotating the motor 17, the two control slide units 2, 2*a* can be simultaneously moved out of their neutral position and into one or the other end position.

As long as the control slide units 2, 2*a* are in pressure contact with the outer ring 20, the two control valves are "active". With the aid of the aforementioned auxiliary piston 8 or 8*a*, the control valves can in addition be brought into an "inactive" position. For this control action, a known switching valve 24 is provided that in the illustrated embodiment comprises a 4/2-way slide valve with magnetic control that is effected by a magnet 25. In the illustrated embodiment, it is presupposed that the pressure chambers 26 and 26*a* that are defined by the auxiliary pistons 8 or 8*a* can be simultaneously controlled by a single switching valve 24.

The connections P and T are respectively constantly connected with the feed line P coming from the source of pressure medium and with the line T that leads to the tank. This can be effected either by direct connecting lines or, as illustrated in the specific embodiment of FIG. 1, via connections within the valve housing 1. In the illustrated embodiment, the switching valve 24 is in the rest position, in which, with the magnet 25 not excited, it is held by the compression spring 27. In this position, the pressure chambers 26, 26*a* are acted upon. As a result, the control slide units 2, 2*a* assume the mechanical end position illustrated in FIG. 1, i.e. the control valves are in the inactive position. In this inactive position, there is no contact between the compo nents 21, 21*a* and the outer ring 20 of the eccentric ring 19. Thus, the motor 17 can be adjusted without moving the control slide units 2, 2*a*. The possible individual switching conditions will subsequently be explained in conjunction with the circuit diagrams of FIGS. 2 to 5. In these diagrams, the slide valves are illustrated using conventional hydraulic symbols.

Figure 2:
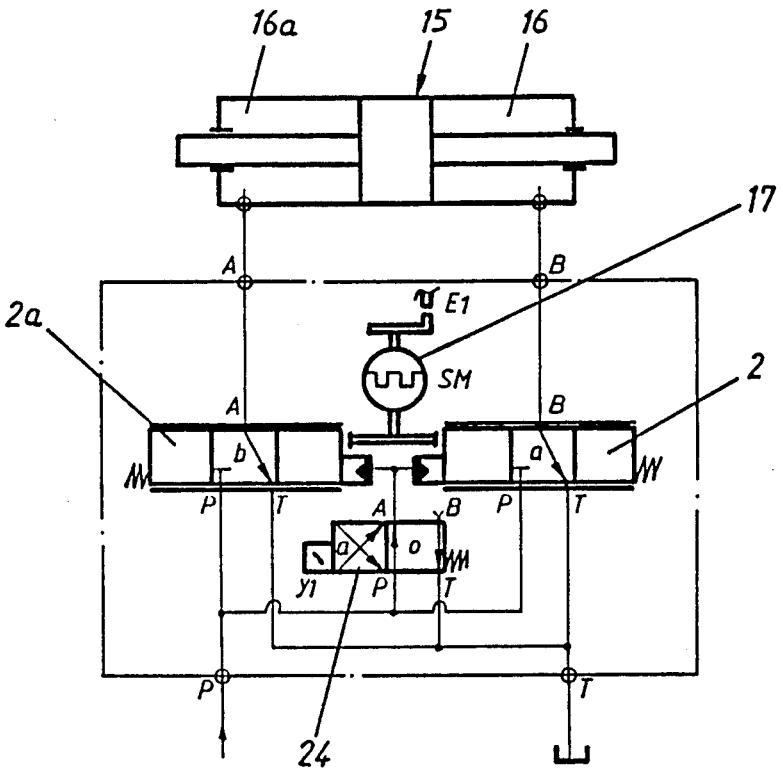
FIG. 2 is a circuit diagram of an electrohydraulic control arrangement of the present invention for controlling a hydraulic cylinder in the switching condition "inactive position" of the control valves.
Figure 3:
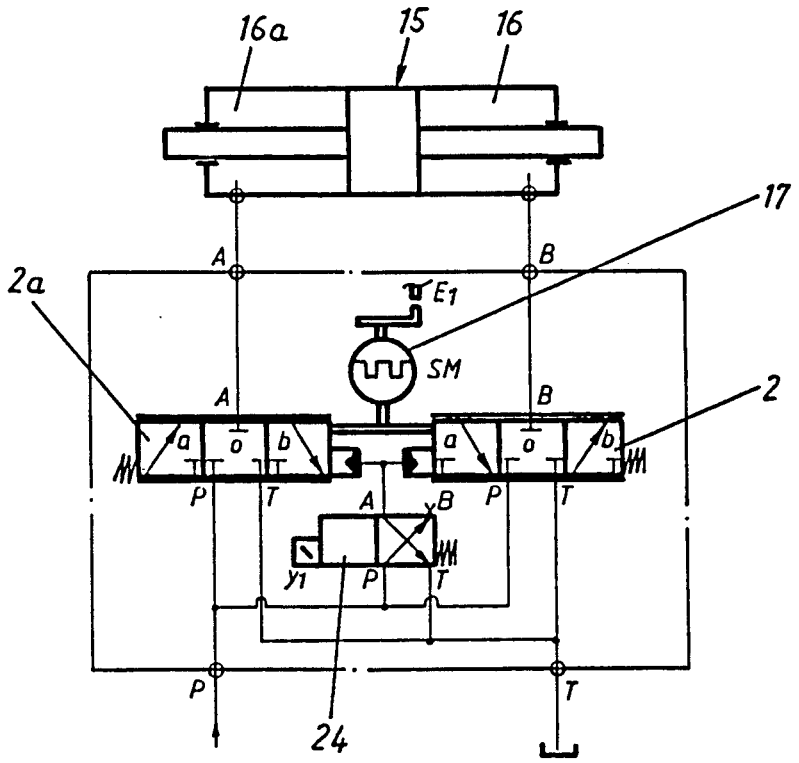
FIG. 3 shows the circuit diagram of FIG. 2 in the switching condition "active position" of the control valve.

The following switching conditions are possible:

1. Control valves inactive (FIG. 2)
2. Control valves active, "stabilized neutral position" (FIG. 3)

Figure 4:
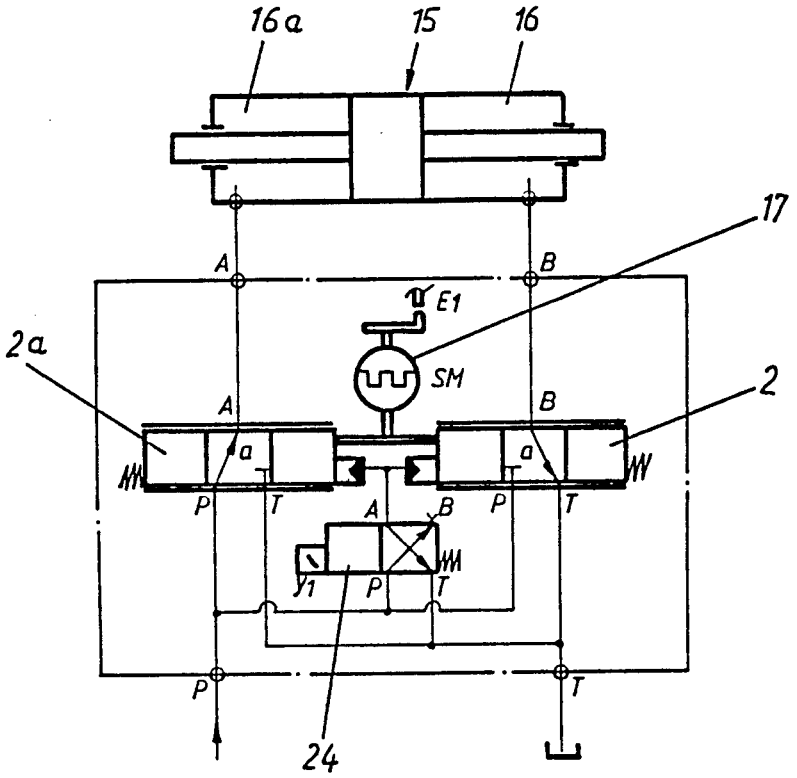
FIG. 4 shows the circuit diagram of FIG. 2 in the switching condition activation of the hydraulic cylinder.
Figure 5:
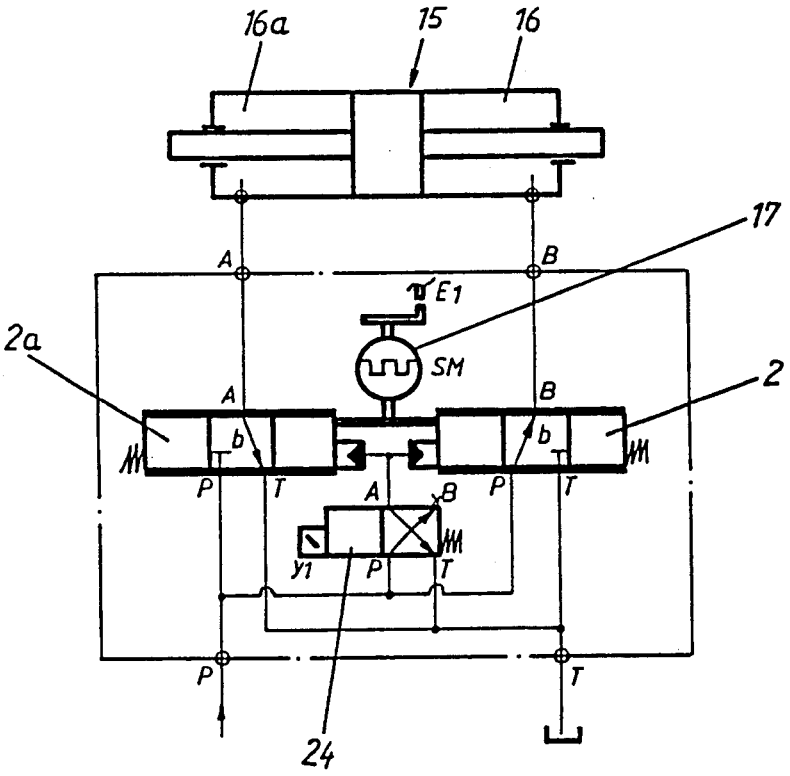
FIG. 5 shows the circuit diagram of FIG. 2 in the switching condition actuation of the hydraulic cylinder in the opposite direction.

2.1 Control valves in a first switching position (FIG. 4) and 2.2 Control valves in a second, oppositely directed switching position (FIG. 5).

Condition 1

The switching valve 24 is in a rest position. The control slide units 2, 2*a* assume the end position illustrated in FIG. 1. There is no mechanical contact with the outer ring 20. The hydraulic symbol illustrated in FIG. 2 is established at the control valves. The position of the reference motor 17 has no effect upon this symbol. The supply P for oil under pressure is cut off, and the hydraulic cylinder 15 has both of the pressure chambers 16, 16*a* relieved to the tank T. In this operating state, the motor 17, if necessary, can be adjusted without thereby activating the control valves.

Condition 2

As a result of an excitation of the magnet 25, the switching valve 24 is in the operating position. The pressure chambers 26, 26*a* are relieved to the tank. The springs 11, 11*a* press the control slide units 2, 2*a* against the outer ring 20. Due to the symmetrical arrangement of the control slide units 2, 2*a*, the contact pressures are offset, so that no additional torque occurs for the motor 17.

If the motor 17 is in the neutral position, the hydraulic symbol illustrated in FIG. 3 is established at the control valves. The control valves are in the active position. The hydraulic cylinder is hydraulically fixed via the connections A and B.

Condition 2.1

If the reference motor 17 is rotated in one direction in conformity with the preset value, the control slide units 2, 2*a*, as shown in FIG. 4, both shift toward the right via the eccentric ring 19. The hydraulic symbol illustrated in FIG. 4 is established at the control valves. This means that the pressure chamber 16*a* of the hydraulic cylinder 15 is acted upon, while the pressure chamber 16 is relieved.

Condition 2.2

The reference motor 17 has been rotated out of the neutral position in the opposite direction. The control slide units 2, 2*a* both shift out of the neutral position toward the left, as shown in FIG. 5, via the effect of the eccentric ring 19. The hydraulic symbol illustrated in FIG. 5 is established at the control valves. This means that now the pressure chamber 16 of the hydraulic cylinder is acted upon, while the pressure chamber 16*a* is relieved to the tank.

With the two switching conditions illustrated in FIGS. 4 and 5, the quantity of pressure medium that flows through to the pressure chambers 16 or 16*a*, and vice versa, is a function of the angle of rotation of the reference motor 17, so that a control circuit can be provided in conjunction with a suitable control action. In each case, the maximum quantity of flowthrough is achieved when the eccentric ring 19 is rotated out of its neutral position in one or the other direction by 90°.

The separate control action of the switching valve 24 offers, in conjunction with the described electrohydraulic control, the great advantage that the "not-stop-function" can be controlled at any given time, regardless of whether or not a controlled state is present. In so doing, the "not-stop-function" can be achieved directly without thereby passing through a "different hydraulic symbol".

The present invention is, of course, in no way restricted to the specific disclosure of the specification and drawings, but also encompasses any modifications within the scope of the appended claims.

What I claim is:

1. In an electrohydraulic control arrangement for controlling a hydraulic drive means, such as a hydraulic cylinder in which each of the opposed sides of a double-acting working piston delimits a pressure chamber, with said arrangement including at least one control valve that is provided with a control slide unit that is spring-loaded at one end and can be shifted out of a rest position against the spring force, and with said arrangement also including a servomotor for controlling said control slide unit, the improvement comprising:

a valve housing having at least one section provided with at least one respective control valve for alliance with each of said pressure chambers of said hydraulic cylinder, with said control slide units of said control valves being spaced from one another and being coaxially disposed in a mirror symmetrical manner relative to one another;

a common control element connected to said servometer and disposed between facing, non-spring loaded inner ends of said control slide units for moving same in the same direction via mechanical pressure contact;

for each of said control slide units, a pressure chamber that contains an auxiliary piston;

at least one switching valve for connecting said pressure chambers of said control slide units with pressure medium for moving said control slide units in a direction counter to said spring force to thereby move said control slide units into an inactive position that avoids the effect of said control element of said servomotor, whereby in said inactive position both of said pressure chambers of said hydraulic cylinder are connected to a first line that leads to a tank, while a second line coming from a supply of pressure medium is cut off by said control slide units;

said control element of said servomotor being embodied as an eccentric lifting ring having an outer surface that serves as a support surface for each of said inner ends of said control slide units, which are disposed on diametrically opposite sides of said lifting ring; and each of said inner ends of said control slide units being provided with a screw-type component having a threaded portion with which an axial length of said component is adjustable.

* * * * *